US005213543A

United States Patent [19]

Clarino

[11] Patent Number: 5,213,543

[45] Date of Patent: May 25, 1993

[54] AIRCAP

[76] Inventor: Robert M. Clarino, 30 Nida Dr., Northford, Conn. 06472

[21] Appl. No.: 742,297

[22] Filed: Aug. 8, 1991

[51] Int. Cl.[5] ..... F24F 13/20

[52] U.S. Cl. ..... 454/292; 49/463; 292/253; 454/284

[58] Field of Search ..... 454/201, 259, 270, 271, 454/300, 310, 275, 276, 284, 289, 292, 370, 347, 367, 359; 49/463, 466; 292/253

[56] References Cited

U.S. PATENT DOCUMENTS

| | | | |
|---|---|---|---|
| 1,431,134 | 10/1922 | Young | 292/253 |
| 2,010,447 | 8/1935 | Wackman | 292/253 |
| 3,115,082 | 12/1963 | Sanoff | 454/276 |
| 4,287,815 | 9/1981 | Henderson | 49/463 X |
| 4,520,715 | 6/1985 | Coomes et al. | 454/367 |
| 5,058,492 | 10/1991 | Norton | 454/259 |

FOREIGN PATENT DOCUMENTS

| | | | |
|---|---|---|---|
| 389633 | 3/1933 | United Kingdom | 292/253 |

*Primary Examiner*—Harold Joyce
*Attorney, Agent, or Firm*—John R. Doherty

[57] ABSTRACT

A cover assembly for ceiling registers connected to the air ducts or the trunk line of a central air conditioning system. The cover assembly is designed to prevent heat and moisture from entering the trunk line through the register or any wall sleeves, gaps and openings. The cover assembly is comprised of a flat rigid material of sufficient size to cover the opening of a ceiling register. The cover has a peripheral seal that presses against the rim face of the register by a fastening device. The fastening device attaches to the ceiling register to secure the cover to the ceiling register with an air tight seal.

4 Claims, 4 Drawing Sheets

AIRCAP

BACKGROUND OF INVENTION

The present invention relates to an improved cover assembly for ceiling registers attached to a central air conditioning system. More particularly, the invention relates to a ceiling register cover assembly which saves heat and energy and stops moisture and mildew from corroding the register.

Dampers are present in most ceiling registers. The damper device consists of a series of metal louvers that run along the inside of the register. The dampers are controlled by a manual lever that will open or close the louvers. In the open position the damper provides an outlet for cooling air to pass from the central air conditioning system. In the closed position the louvers will pivot and act like a shutter stopping any room heat that is being generated from a separate heating system from entering. The problem exists in the closed position, the louvers barely make contact creating gaps and spaces for heat and moisture to penetrate. As the heat penetrates this creates a heat loss and a waste of energy. As the moisture penetrates, the damper mechanism will start to corrode rendering the dampers inoperative.

U.S. Pat. No. 4,520,715 to Coomes 1985 discloses a thick styrofoam cover with two fastening means; however after installation a heat loss still exists. The fastener creates an opening between the register and the interior wall by lifting the register to install the fastening device. This exposes the inner sleeve of the duct and the outer wall area.

Another fastening means is disclosed in this patent which uses Velcro as a fastener and which also creates a heat path. The Velcro is attached to the rim face of the register and the backside of the cover. The cover is mounted by the interconnection of the Velcro pieces. Once the cover is mounted, the cover is no longer against the register face and an opening is created by the thickness of the Velcro that extends the rim face. Finally this cover does not solve the problem of losing heat and saving energy because of the additional gaps and openings that are created after the cover is installed.

U.S. Pat. No. 4,287,815 to Henderson 1981 discloses a fan cover which also lifts the rim of the fan unit away from the interior wall to install the fastening devices thereby creating additional gaps for heat to escape.

Accordingly, an important object of the present invention is to provide an improved cover assembly which will produce an air tight seal to save heat and energy. Another object is to provide a cover assembly which will not create any additional gaps or opening for heat to penetrate. Still another object is to provide a cover assembly which will stop moisture and mildew from entering the register and trunk lines of the central air conditioning system. Yet another object is to provide a cover assembly which will stop the ceiling registers from corroding in bathrooms. A further object is a cover assembly which will effectively replace the damper closing function. A still further object is a cover assembly which is easily installed and removed by the average lay person as needed. Still another object is to provide a cover assembly which is decorative and acceptable for the interior of a commercial building or home.

SUMMARY OF THE INVENTION

The present invention is directed to an improved cover assembly for ceiling registers attached to a central air conditioning system. The cover assembly will replace the closing function of the damper. The damper is closed when a separate heating system is in use not connected to the central air conditioning system. The cover has a sealing member which is pressed tightly against the rim face of the register by a fastening device, thereby eliminating any gaps or spaces for heat to penetrate. The fasteners which attach to the register will not modify the ceiling register, as originally installed. This will allow the register to remain against the inner wall without creating any additional heat paths. The cover assembly will save heat and energy by improving the damper function. In bathrooms, the cover assembly will stop moisture and mildew from corroding the register and inner trunk line of the air conditioning system.

BRIEF DESCRIPTION OF THE DRAWING

The present invention will now be described in greater detail by reference to the accompanying drawing which discloses the preferred embodiments and wherein.

DESCRIPTION OF PREFERRED EMBODIMENT

Figure 1:
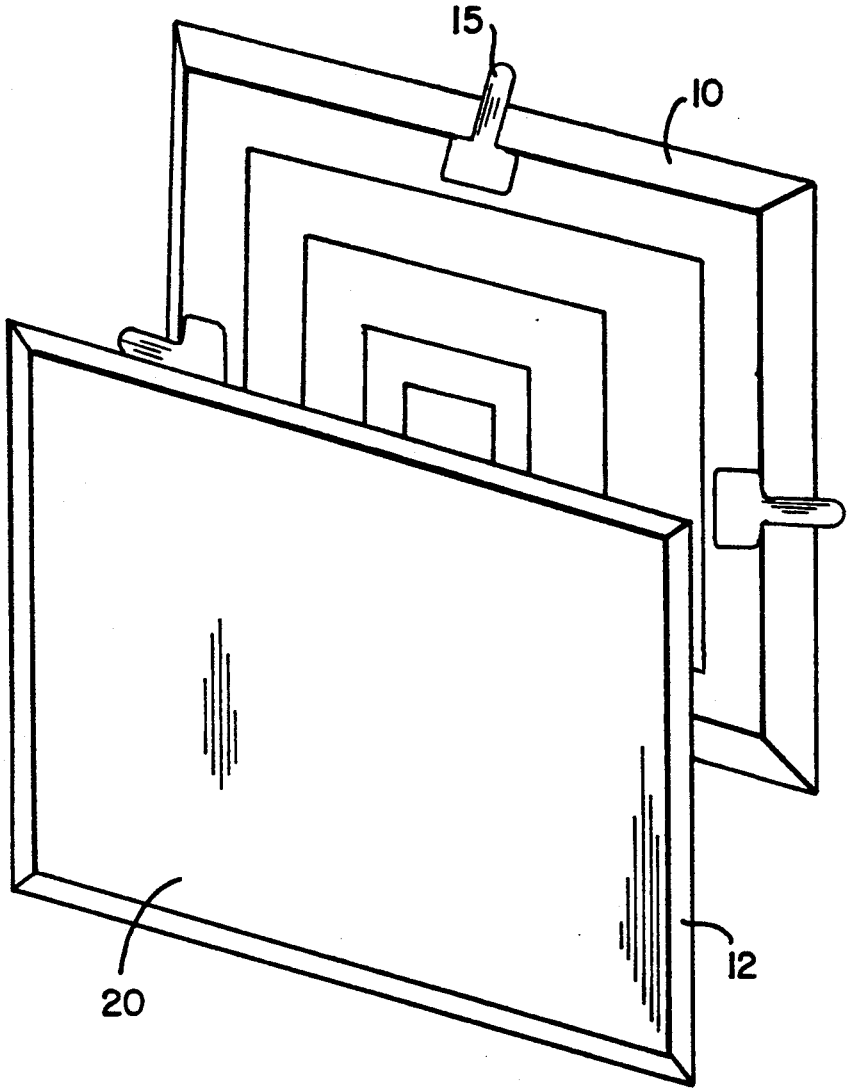
FIG. 1. is a perspective view of a cover assembly for a ceiling register according to the invention.
Figure 3:
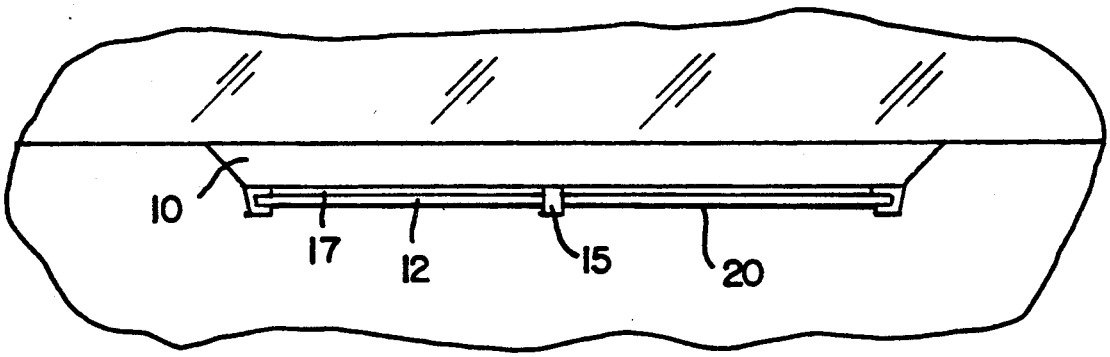
FIG. 3. is an elevational view of the cover assembly mounted to the ceiling.
Figure 2:
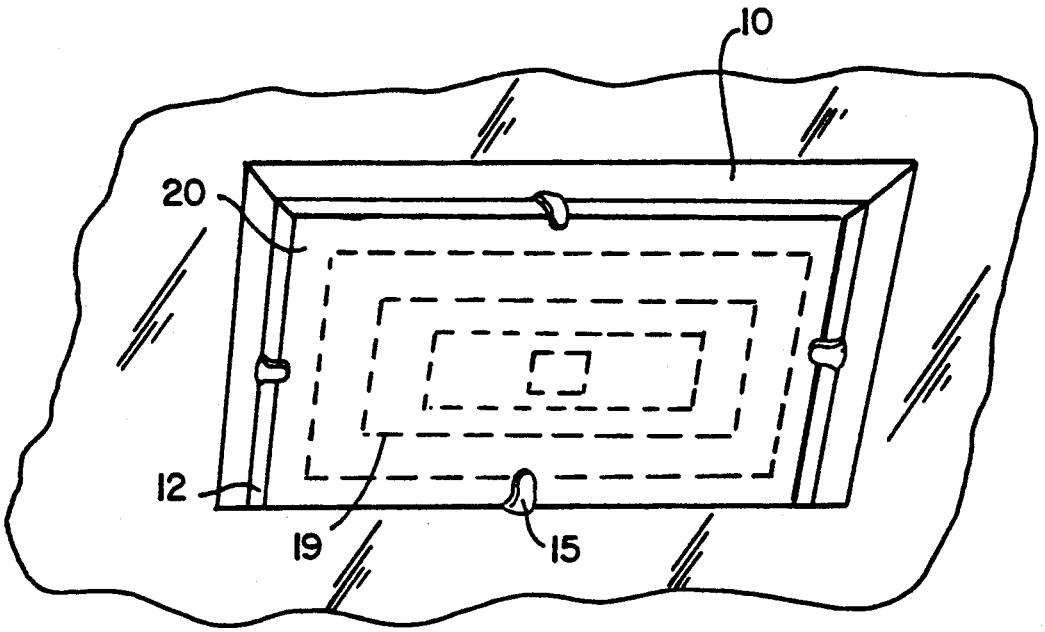
FIG. 2. is a similar view of the cover assembly mounted to a ceiling register with the rigid plate overlaying the air cooling passage.

A typical embodiment of the improved cover assembly of the present invention is illustrated in FIGS. 2 and 3. In the preferred embodiment the cover assembly 20 has a laminated exterior with a thin layer of styrofoam in the center. A product sold under the trade name of Gaterfoam is ideal for this purpose. However the cover assembly 20 can be a sheet of white corrugated plastic, polyethylene foam, plexiglass, laminated fibrous material, or various plasticize material, cardboard, etc.

Figure 4:
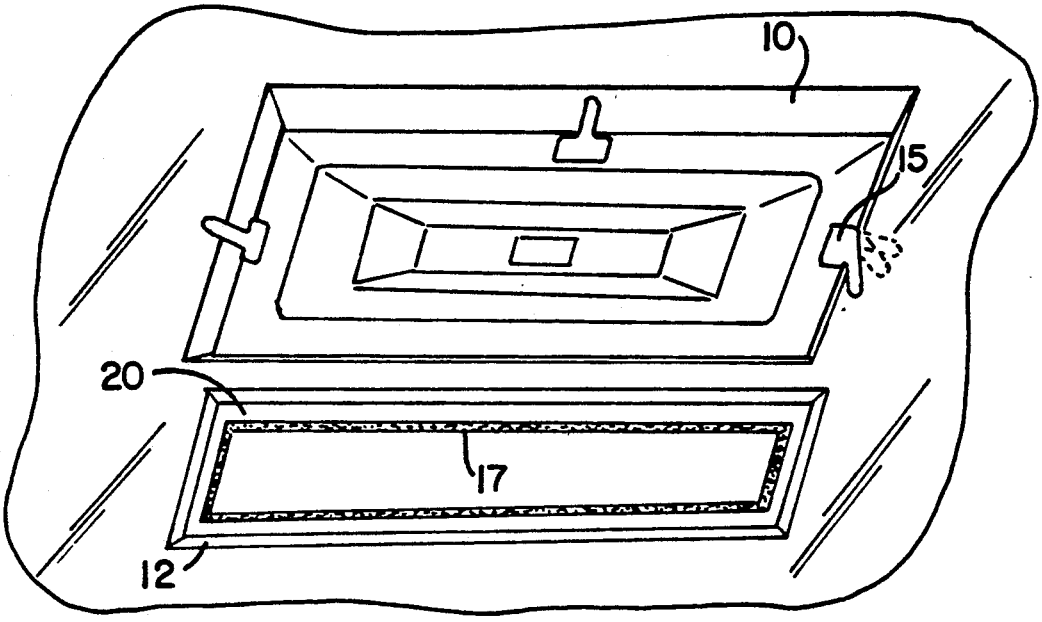
FIG. 4. is a similar view of the cover assembly with the back side of the cover revealing the peripheral seal in relationship to the ceiling register.

On the surrounding edges of the improved cover assembly 20 a rubber or plastic u channel molding 12 fits over the edges to provide a decorative finish to the improved cover assembly 20. On the backside of the cover assembly 20 a self adhesive peripheral seal 17 is attached to eliminate any openings or spaces and to increase the insulating capabilities of the cover assembly 20. The peripheral seal 17 and the fastener with its attachment base 15 and its attachment arm 16 enable the improved cover assembly 20 to provide an air tight seal. FIG. 3 reveals the side view of the peripheral seal 17 after installation. A closer look at FIG. 4 reveals the peripheral seal 17 mounted to backside of the cover assembly 20 before installation.

Figure 5:
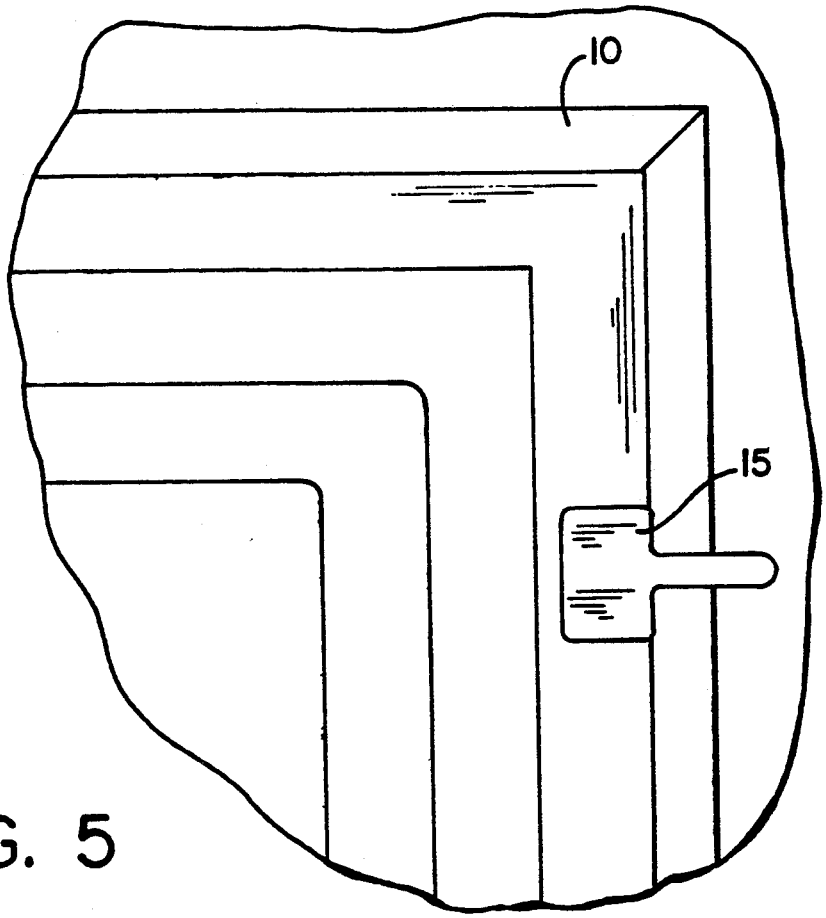
FIG. 5. is a planar view of the ceiling register revealing the fastening mechanism attached to it.
Figure 6:
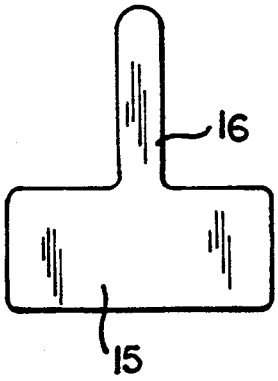
FIG. 6 is an elevational view of the fastening mechanism.
Figure 7:
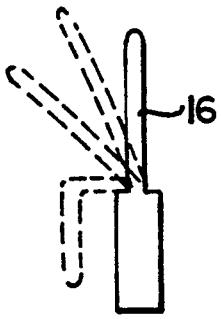
FIG. 7. is a similar view of the fastening mechanism with phantom lines showing its mode of operation.

The fastening attachment base 15 and its fastening attachment arm 16 are illustrated in FIGS. 5 and 6. The fastening attachment base 15 has an adhesive side that mounts easily to the face of ceiling register 10. The fastening attachment arm 16 is a flexible material that can be repeatedly opened and closed without fracturing. Both parts are vinyl coated which provides a smooth custom finish that complements the cover assembly 20.

FIG. 2 illustrates the improved cover assembly 20 installed to the ceiling register 10. The grill and the damper system 19 is completely covered without any openings or spaces. The fastening attachment arm 16 will compress the cover assembly 20 with the peripheral seal 17 to the base of the fastening attachment base 15 and to the face of ceiling register 10. An air tight seal has now been created so that heat and moisture or any other elements can not penetrate. A tight seal is needed that encompasses the complete ceiling register face 10 if the cover assembly 20 is to be effective in saving heat and providing a barrier to moisture in rooms where baths and showers are installed.

Figure 8:
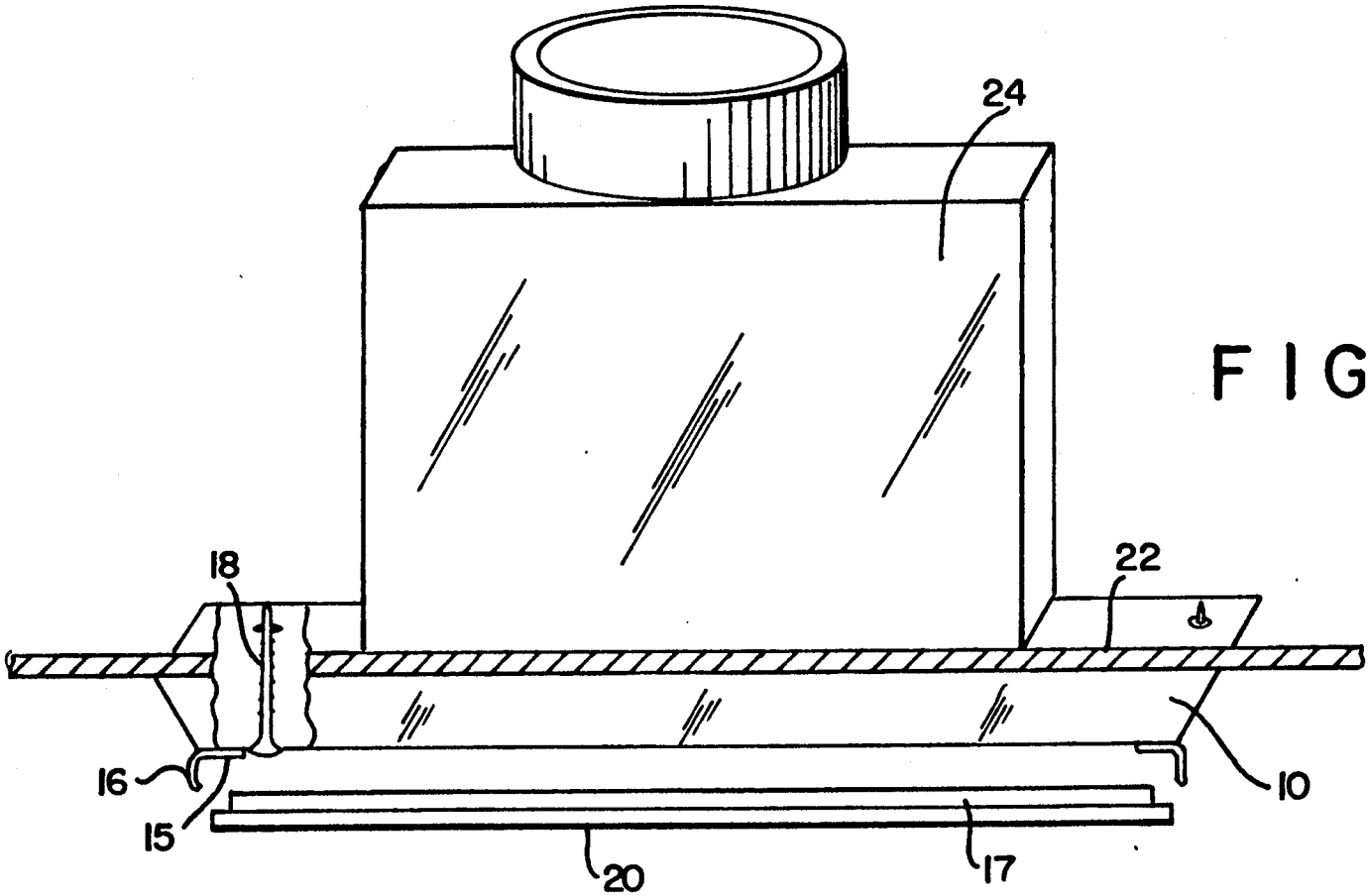
FIG. 8. is an elevational view of the cover assembly showing a means for securing the backside of the register in air tight engagement with a wall.

FIG. 8 illustrates the ceiling register 10 with a cut out view of the fastening screws 18 that connect the backside of ceiling register 10 through the inner wall 22 to the air conditioning supply duct 24. This enable the ceiling register 10 to mount securely to the inner wall without any gaps or spaces to exist, thereby creating an air tight seal.

The manner of using the improved cover assembly 20 to seal off a ceiling register 10 is best described in the following procedures: the user first takes the cover assembly 20 and aligns it evenly to the face of ceiling register 10. Once it's aligned, one hand supports the cover assembly 20 in place, while the other hand bends the fastening attachment arm 16 over the cover assembly 20. Once all the fastening attachment arms 16 are in place, the cover assembly 20 and the peripheral seal 17 are compressed against the ceiling register 10 and installation is complete.

To remove the improved cover assembly 20, the user first supports the front side of the cover assembly 20 with one hand, while the other hand opens the fastening attachment arm 16. The cover assembly 20 can now be removed and stored till next season. The fastening attachment arm 16 can now be bent back to provide a uniform look to the ceiling register 10.

What is claimed is:

1. In combination: a ceiling register including a framework having a front face and a backside which abuts against the surface of the ceiling in which said register is mounted in substantially air-tight engagement therewith, said front face including a rim surrounding an opening for passage of air through said register, and a cover assembly for sealing said opening when said ceiling register is not in use, said cover assembly comprising a flat rigid plate of a size sufficient to overlie said opening and at least a portion of said rim adjacent to said opening, means affixed to said rim for removably attaching said rigid plate to said front face, said attaching means comprising at least one fastener including a base and an elongated bendable member, said base including an adhesive material on one side thereof affixing said base to said rim, and a compressible sealing member disposed on one side of said rigid plate between said plate and said rim, said sealing member extending substantially continuously around the periphery of said rigid plate contacting said rim and at least a portion of said base affixed to said rim, said elongated bendable member extending around an edge of said rigid plate and engaging the opposite side of said rigid plate forcing said rigid plate inwardly toward said rim and compressing said sealing member, thereby establishing a substantially air-tight seal around said rim and said portion of said base affixed to said rim.

2. The combination as defined by claim 1 wherein said rigid slate is made from a material selected from the group consisting of styrofoam, urethane foam, polyethylene foam, corrugated plastic and plexiglass.

3. The combination as defined by claim 1 wherein said rigid plate has a U-shaped molding surrounding the peripheral edges thereof.

4. The combination as defined by claim 1 wherein said elongated bendable member is made from a flexible material that can be repeatedly deflected without fracturing.

* * * * *